US010366853B1

(12) United States Patent
Candelora et al.

(10) Patent No.: US 10,366,853 B1
(45) Date of Patent: Jul. 30, 2019

(54) COLLAPSIBLE LINKS FOR CIRCUIT BREAKERS, SYSTEMS, AND METHODS OF USE THEREOF

(71) Applicant: ABB Schweiz AG, Baden (CH)

(72) Inventors: Andrew Matthew Candelora, East Haven, CT (US); Amit Bose, Andhra Pradesh (IN); Dhirendra Kumar Tiwari, Farmington, CT (US); Katherine Marjorie Coughlin, West Hartford, CT (US); Shawn Couceiro Fonseca, Newington, CT (US)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/862,952

(22) Filed: Jan. 5, 2018

(51) Int. Cl.
*H01H 71/52* (2006.01)
*H01H 71/02* (2006.01)
*H01H 1/58* (2006.01)

(52) U.S. Cl.
CPC ..... *H01H 71/528* (2013.01); *H01H 1/5833* (2013.01); *H01H 71/025* (2013.01); *H01H 71/0221* (2013.01); *H01H 2300/046* (2013.01)

(58) Field of Classification Search
CPC ..... H01H 1/5833; H01H 9/20; H01H 71/528; H01H 71/522–71/524; H01H 71/0221; H01H 71/025
USPC ..... 200/401, 440, 146 R, 244, 400
See application file for complete search history.

(56) References Cited

U.S. PATENT DOCUMENTS 2,492,009 A * 12/1949 Sandin ..... H01H 71/1054 200/401
3,139,494 A 6/1964 Caswell
3,191,096 A 6/1965 Frank
3,251,963 A 5/1966 Date
3,265,836 A 8/1966 Gauthier et al.
3,492,614 A * 1/1970 Deangelo ..... B32B 27/00 335/191
3,754,108 A 8/1973 Marot et al.
4,090,158 A * 5/1978 Oeda ..... H01H 71/04 335/17
4,472,701 A * 9/1984 Bellows ..... H01H 73/04 335/23
4,882,557 A * 11/1989 Harper ..... H01H 71/002 335/9
5,142,112 A * 8/1992 Parks ..... H01H 71/501 200/401
5,213,206 A * 5/1993 Beck ..... H01H 71/501 200/327

(Continued)

*Primary Examiner* — Edwin A. Leon
*Assistant Examiner* — William A Bolton
(74) *Attorney, Agent, or Firm* — Barnes & Thornburg LLP

(57) ABSTRACT

A collapsible link device includes a side frame, a carrier, a main contact arm, a plurality of collapsible links, and a release mechanism. The carrier is pivotably coupled to the side frame. The main contact arm is pivotably coupled to the carrier and includes a first end including a first electrical contact. The plurality of collapsible links are pivotably coupled to the side frame and the carrier. The release mechanism is pivotably coupled to at least one of the collapsible links and the carrier. The plurality of collapsible links are movable between an uncollapsed position in which the first electrical contact contacts a second electrical contact and a collapsed position that results from the first electrical contact separating from the second electrical contact.

18 Claims, 9 Drawing Sheets

(56) References Cited

U.S. PATENT DOCUMENTS

| | | | | |
|---|---|---|---|---|
| 5,278,373 | A * | 1/1994 | Faber | H01H 71/16 200/401 |
| 5,290,982 | A | 3/1994 | Beck et al. | |
| 5,293,016 | A * | 3/1994 | Nar | H01H 71/528 200/401 |
| 5,296,664 | A * | 3/1994 | Crookston | H01H 71/501 200/401 |
| 5,920,451 | A | 7/1999 | Fasano et al. | |
| 6,031,438 | A | 2/2000 | Runyan | |
| 6,069,544 | A | 5/2000 | Seymour et al. | |
| 6,084,191 | A * | 7/2000 | Kataya | H01H 71/501 200/401 |
| 6,376,788 | B1 | 4/2002 | Jones et al. | |
| 6,800,824 | B1 | 10/2004 | Slepian et al. | |
| 2004/0145846 | A1 | 7/2004 | Fasano et al. | |

* cited by examiner

COLLAPSIBLE LINKS FOR CIRCUIT BREAKERS, SYSTEMS, AND METHODS OF USE THEREOF

BACKGROUND

The field of the disclosure relates generally to mechanical devices for circuit breakers, and, more specifically, to a collapsible link device for quick termination of an electrical connection.

Circuit breakers include electrical contacts that complete a circuit with an electrical system. However, the flow of current to connected loads is interruptible by separating the electrical contacts during an interrupt event, such as in a short circuit event. Damage may occur to the circuit breaker and/or to downstream electrical equipment if the flow of current is not interrupted quickly enough. As such, faster separation of electrical contacts may protect the circuit breaker and may protect downstream electrical equipment.

BRIEF DESCRIPTION

In one aspect, a collapsible link device for a circuit breaker is provided. The collapsible link device includes a side frame, a carrier, a main contact arm, a plurality of collapsible links, and a release mechanism. The carrier is pivotably coupled to the side frame. The main contact arm is pivotably coupled to the carrier and includes a first end including a first electrical contact. The plurality of collapsible links are pivotably coupled to the side frame and the carrier. The release mechanism is pivotably coupled to at least one of the collapsible links and the carrier. The plurality of collapsible links are movable between an uncollapsed position in which the first electrical contact contacts a second electrical contact and a collapsed position that results from the first electrical contact separating from the second electrical contact.

In another aspect, a method of manufacturing a collapsible link device for a circuit breaker is provided. The method includes pivotably coupling a carrier and a main contact arm to a side frame. A first end of the main contact arm including a first electrical contact. The method also includes pivotably coupling a plurality of collapsible links to the side frame and the carrier. The method further includes coupling a release mechanism to the carrier. The plurality of collapsible links are movable between an uncollapsed position in which the first electrical contact contacts a second electrical contact and a collapsed position that results from the first electrical contact separating from the second electrical contact.

DRAWINGS

These and other features, aspects, and advantages of the present disclosure will become better understood when the following detailed description is read with reference to the accompanying drawings in which like characters represent like parts throughout the drawings, wherein.

Figure 1:
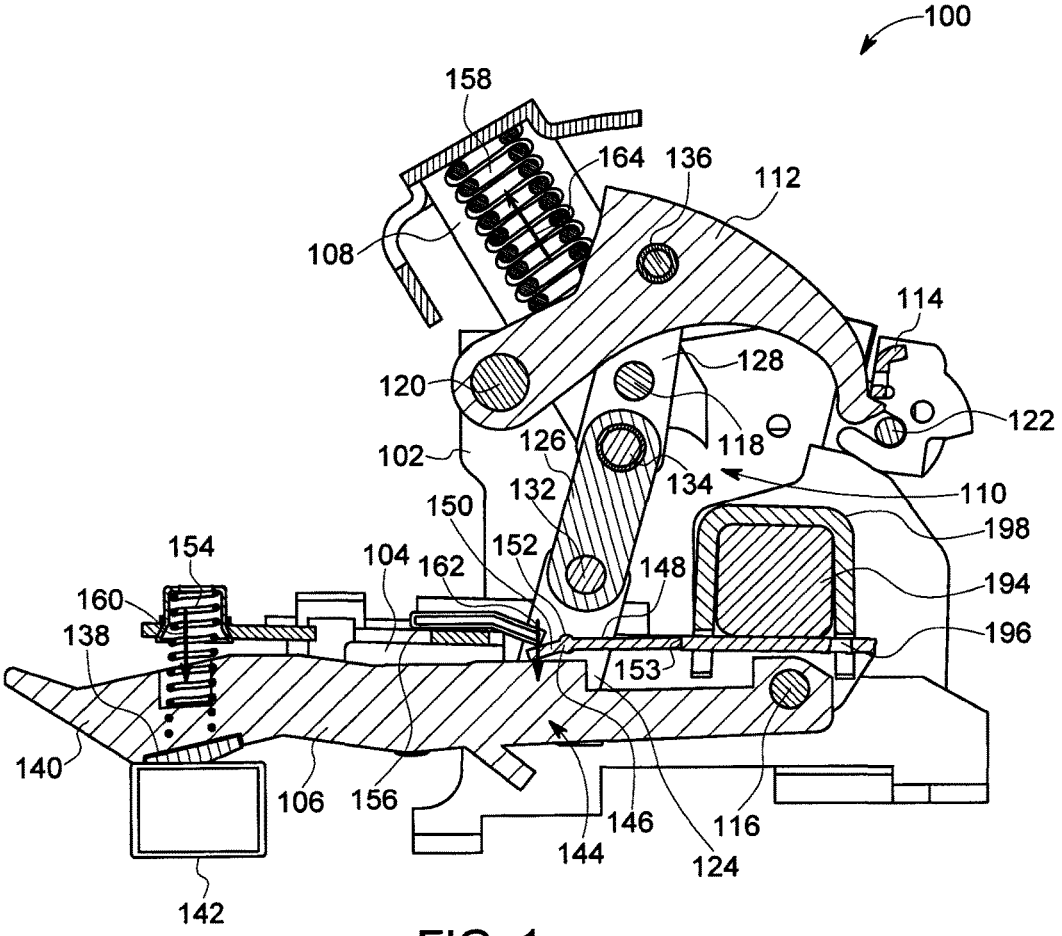
FIG. 1 is a schematic diagram of an exemplary embodiment of a collapsible link device before an interrupt event.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, and such ranges are identified and include all the sub-ranges contained therein unless context or language indicates otherwise.

The collapsible link devices and associated systems and methods described herein are suited to quickly disconnect electrical contacts in a circuit breaker during an interrupt event, such as a short circuit event. Quickly disconnecting the electrical contact prevents damage to the circuit breaker and to downstream electrical equipment. The collapsible link devices of the present disclosure include a main contact arm, a first electrical contact positioned on a first end of the main contact arm and electrically coupled to a second electrical contact of an electrical system, a release mechanism, a plurality of collapsible links, and a plurality of springs. During normal operation (i.e., in the absence of an interrupt event), the collapsible links, the main contact arm, the springs, and the release mechanism are configured to maintain contact between the first and second electrical contacts. During an interrupt event, such as a short circuit event, electromagnetic forces caused by the interrupt event push the first electrical contact away from the second electrical contact, causing the main contact arm to pivot about a first pivot point. Rotation of the main contact arm actuates the release mechanism which, in turn, releases the collapsible links and pivots the first electrical contact away from the second electrical contact. The springs are coupled to the collapsible links and accelerate the pivot of the main contact arm. In a first embodiment, the release mechanism includes a link trip latch that releases the collapsible links by rotating when the main contact arm rotates. In a second embodiment, the release mechanism includes a link pin that releases the collapsible links by sliding out of a slot.

FIG. 1 is a schematic diagram of an exemplary embodiment of collapsible link device 100 for use in a circuit breaker before an interrupt event, or during normal operations. In the exemplary embodiment, collapsible link device 100 includes a side frame 102, a carrier 104, a main contact arm 106, a handle 108, a plurality of collapsible links 110, a cradle 112, and a latch 114. Carrier 104, main contact arm 106, handle 108, collapsible links 110, cradle 112, and latch 114 are all pivotably coupled to side frame 102. Carrier 104 and main contact arm 106 are pivotably coupled to side frame 102 by a first pivot pin 116. Handle 108 and collapsible links 110 are pivotably coupled to side frame 102 by a second pivot pin 118. Cradle 112 is pivotably coupled to side frame 102 by a third pivot pin 120. Latch 114 is pivotably coupled to side frame 102 by a fourth pivot pin 122.

In the exemplary embodiment, collapsible links 110 include three links: a lower link 124, a cam link 126, and an upper link 128. In alternative embodiments, collapsible links 110 include any number of links that enable collapsible link device 100 to operate as described herein. Lower link 124 is pivotably coupled to carrier 104 by a fifth pivot pin 130 (shown in FIGS. 3 and 4). Lower link 124 is also pivotably coupled to cam link 126 by a sixth pivot pin 132. Cam link 126 is pivotably coupled to upper link 128 by a seventh pivot pin 134. Upper link 128 is pivotably coupled to handle 108 by second pivot pin 118 and is pivotably coupled to cradle 112 by an eighth pivot pin 136.

In the exemplary embodiment, main contact arm 106 includes a first electrical contact 138 on a first end 140 of main contact arm 106. The circuit breaker include a second electrical contact 142. As shown in FIG. 1, during a first operational mode, first electrical contact 138 is electrically coupled to and contacts second electrical contact 142 to complete a circuit within an electrical system. During the first operational mode, current flows between second electrical contact 142 and first electrical contact 138.

In the exemplary embodiment, collapsible link device 100 includes a release mechanism 144. In the illustrated embodiment, release mechanism 144 includes a trip latch link 146. Trip latch link 146 includes a first end 148 and a second end 150, and is pivotably coupled to lower link 124 by a ninth pivot pin 152. First end 148 and second end 150 of trip latch link 146 are positioned on opposite sides of ninth pivot pin 152. In the exemplary embodiment, second end 150 of trip latch link 146 is positioned at an angle relative to first end 148 of trip latch link 146. Trip latch link 146 is configured to maintain electrical contact between first electrical contact 138 and second electrical contact 142 by maintaining carrier 104, main contact arm 106, and collapsible links 110 in a first position or an uncollapsed position (i.e., the configuration shown in FIG. 1). Specifically, first end 148 of trip latch link 146 is pressed against a flat portion 153 of carrier 104, preventing rotation of lower link 124, which, in turn, prevents collapsible links 110 from collapsing. Collapsible links 110 are movable between the uncollapsed position in which first electrical contact 138 contacts second electrical contact 142 and a second position or collapsed position (i.e., the configuration shown in FIG. 4) that results from first electrical contact 138 separating from second electrical contact 142.

In the exemplary embodiment, collapsible link device 100 includes three biasing members or springs: a main arm spring 154, a flat spring 156, and an interrupt spring 158. Main arm spring 154 is coupled between first end 140 of main contact arm 106 and carrier 104. Main arm spring 154 imparts a biasing force against first end 140 of main contact arm 106 in a first direction 160, imparting to main contact arm 106 a moment, or pivoting force or movement, about first pivot pin 116 which maintains contact between first electrical contact 138 and second electrical contact 142.

Flat spring 156 is coupled between carrier 104 and second end 150 of trip latch link 146. Flat spring 156 imparts a biasing force against second end 150 of trip latch link 146 in a second direction 162, imparting to trip latch link 146 a moment, or pivoting force or movement, about ninth pivot pin 152 which maintains contact between first end 148 of trip latch link 146 and flat portion 153 of carrier 104.

Interrupt spring 158 is coupled between handle 108 and second pivot pin 118. Interrupt spring 158 imparts a biasing force that pulls second pivot pin 118 and upper link 128 in a third direction 164 towards handle 108. Pulling second pivot pin 118 and upper link 128 in third direction 164, absent moving forces, causes collapsible links 110 to collapse, rotating carrier 104, main contact arm 106, and first electrical contact 138 away from second electrical contact 142. In the exemplary embodiment, trip latch link 146 prevents collapsible links 110 from collapsing and maintaining contact between first electrical contact 138 and second electrical contact 142.

Figure 2:
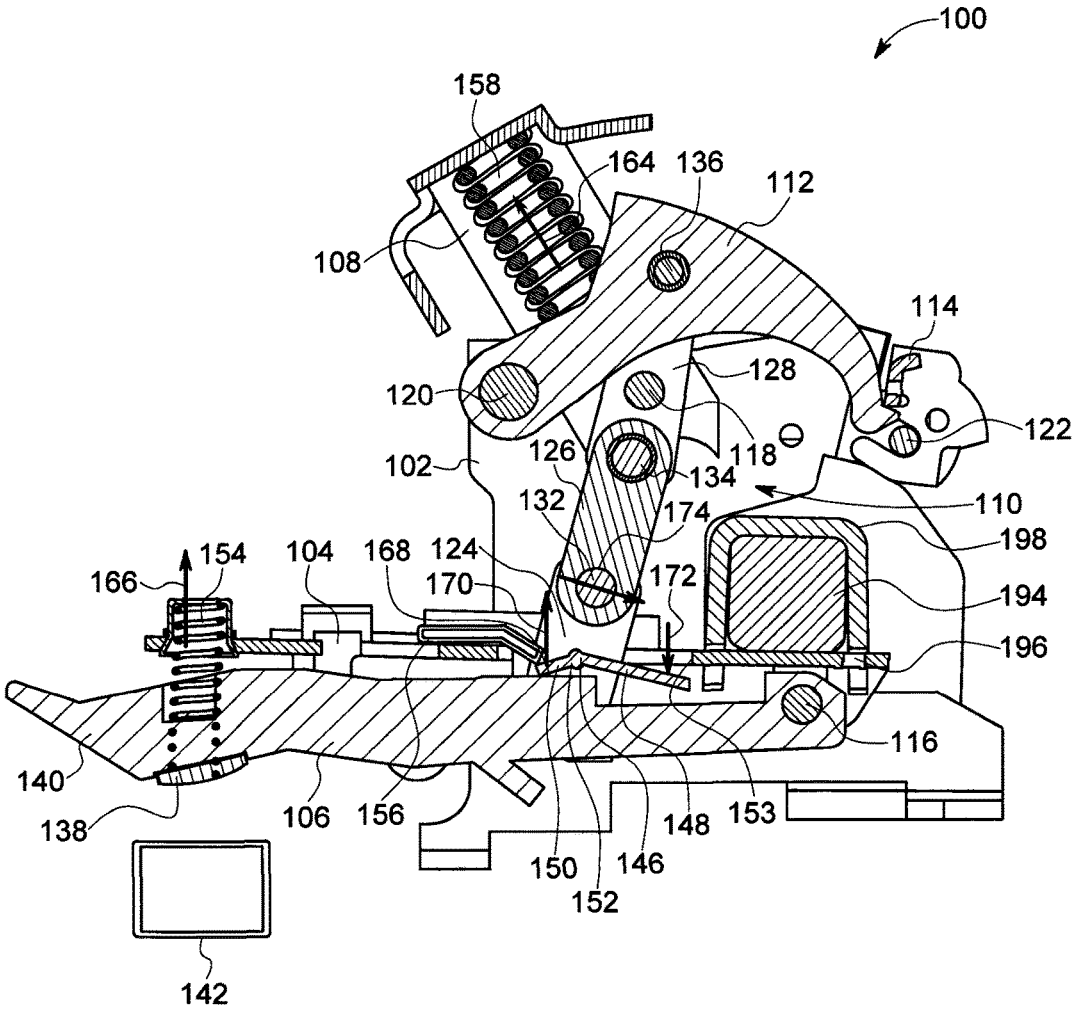
FIG. 2 is a schematic diagram of the collapsible link device shown in FIG. 1 at the initiation of an interrupt event.

During an interrupt event, such as a short circuit of the electrical system, electromagnetic forces repel first electrical contact 138 away from second electrical contact 142. FIG. 2 is a schematic diagram of collapsible link device 100 at the initiation of an interrupt event. As the electromagnetic forces repelling first electrical contact 138 away from second electrical contact 142 increase, main contact arm 106 begins to pivot or rotate about first pivot pin 116 in a fourth direction 166 opposite first direction 160. Main arm spring 154 has a predetermined spring constant and imparts a predetermined resistive force against the rotation of main contact arm 106 in fourth direction 166. As such, main arm spring 154 is operable to prevent rotation of main contact arm 106 until the repulsive electromagnetic forces exceed the predetermined resistive force of main arm spring 154.

As main contact arm 106 rotates about first pivot pin 116, a contact portion 168 of main contact arm 106 makes contact with and rotates second end 150 of trip latch link 146 about ninth pivot pin 152 in a fifth direction 170. Flat spring 156 includes a predetermined spring constant and imparts a predetermined resistive force against the rotation of second end 150 of trip latch link 146 in fifth direction 170. As such, flat spring 156 is operable to prevent rotation of second end 150 of trip latch link 146 until the rotational force from contact portion 168 of main contact arm 106 exceeds the predetermined resistive force of flat spring 156. Rotating trip latch link 146 about ninth pivot pin 152 rotates first end 148 of trip latch link 146 away from flat portion 153 of carrier 104 in a sixth direction 172 opposite fifth direction 170, causing lower link 124 to rotate about fifth pivot pin 130 in a seventh direction 174 and collapsing collapsible links 110.

Figure 3:
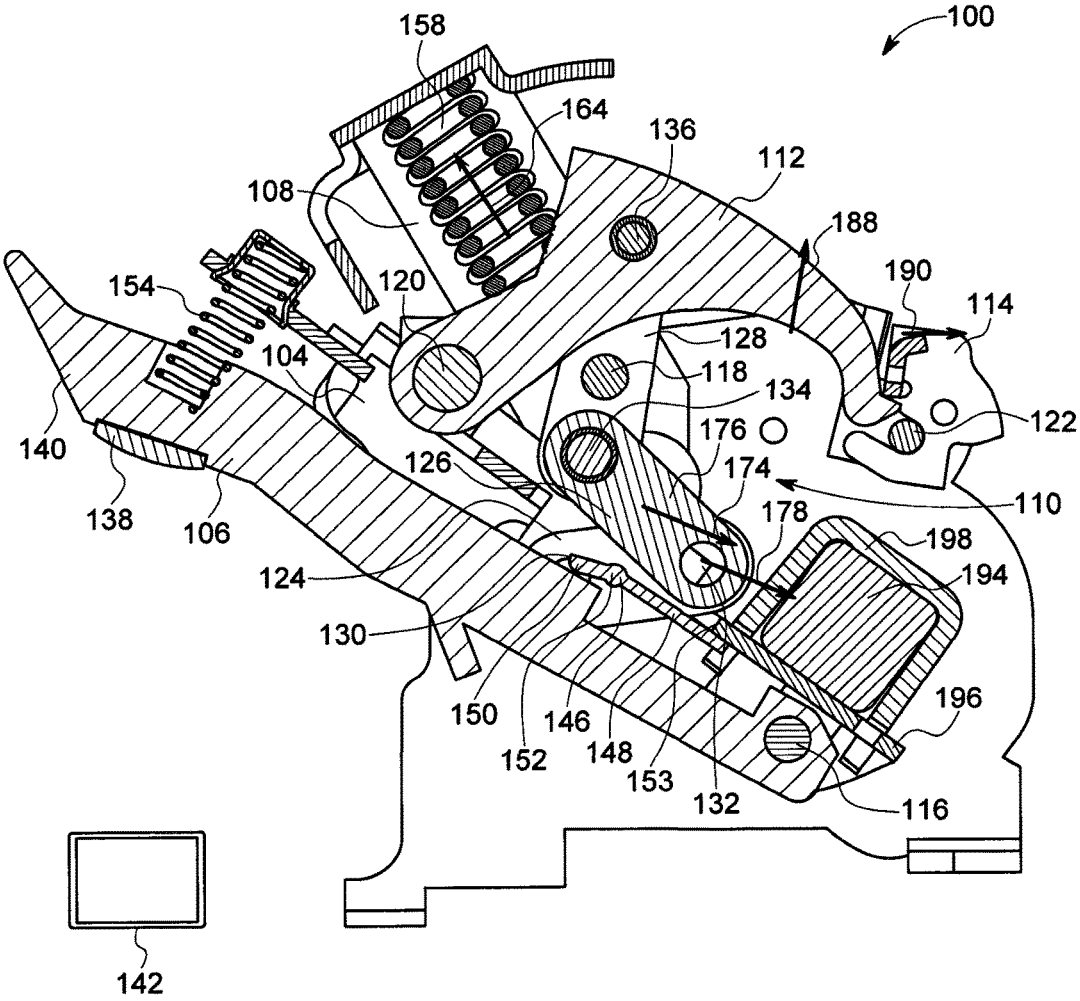
FIG. 3 is a schematic diagram of the collapsible link device shown in FIG. 1 after the initiation of an interrupt event.

After an interrupt event has been initiated, collapsible links 110 rapidly collapse and rotate first electrical contact 138 away from second electrical contact 142. FIG. 3 is a schematic diagram of collapsible link device 100 after the initiation of an interrupt event. As lower link 124 rotates about fifth pivot pin 130 in seventh direction 174, sixth pivot pin 132 and a lower portion 176 of cam link 126 translate in an eight direction 178 such that cam link 126 rotates about seventh pivot pin 134. As shown in FIGS. 1 and 2, lower link 124 and cam link 126 are initially maintained in a straight alignment that prevents carrier 104 and main contact arm 106 from rotating about first pivot pin 116 and maintains an electrical connection between first electrical contact 138 and second electrical contact 142. After the straight alignment of lower link 124 and cam link 126 is broken as shown in FIG. 3, the repulsive electromagnetic forces between first electrical contact 138 and second electrical contact 142 cause carrier 104 and main contact arm 106 to rotate about first pivot pin 116 and rotates first electrical contact 138 away from second electrical contact 142, breaking the circuit within the electrical system and ending the interrupt event.

Figure 4:
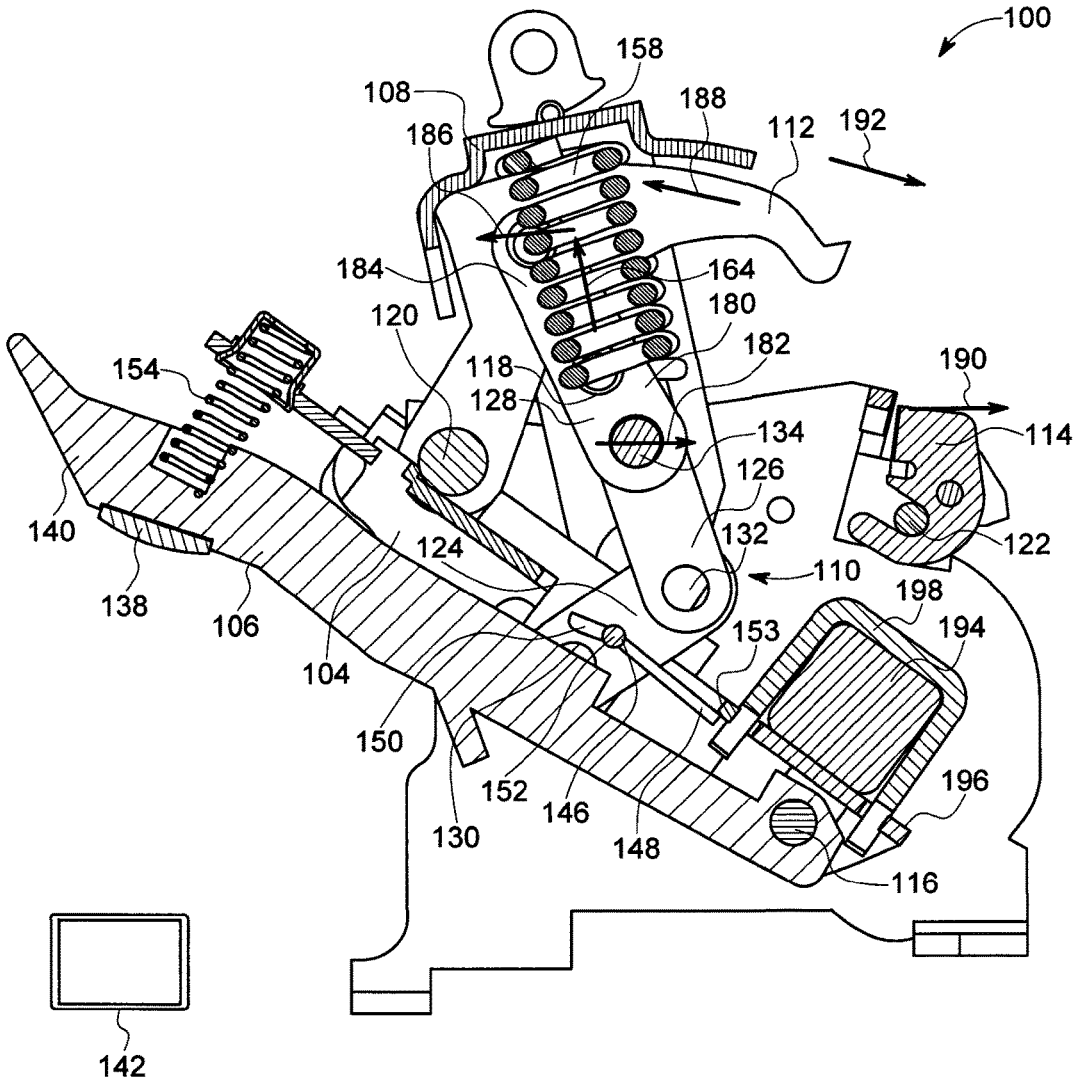
FIG. 4 is a schematic diagram of the collapsible link device shown in FIG. 1 at the end of an interrupt event.

To prevent damage to the circuit breaker and to downstream electrical equipment within the electrical system, interrupt spring 158 pulls collapsible links 110 toward handle 108, thereby rotating carrier 104 and main contact arm 106 about first pivot pin 116 faster. FIG. 4 is a schematic diagram of collapsible link device 100 at the end of an interrupt event. After collapsible links 110 have collapsed, interrupt spring 158 pulls second pivot pin 118 and upper link 128 in third direction 164 towards handle 108. Pulling upper link 128 in third direction 164 causes a lower portion 180 of upper link 128 to pivot about second pivot pin 118 in a ninth direction 182 and an upper portion 184 of upper link 128 to pivot about second pivot pin 118 in a tenth direction 186 while translating upper link 128 in third direction 164 toward handle 108. Rotating lower portion 180 of upper link 128 to pivot about second pivot pin 118 causes cam link 126 to rotate about sixth pivot pin 132 in ninth direction 182 and pulls cam link 126 and lower link 124 in third direction 164. Pulling lower link 124 in third direction 164 causes carrier 104 and main contact arm 106 to rotate further away from second electrical contact 142. As such, interrupt spring 158 increases the separation of first electrical contact 138 from second electrical contact 142 and increases the rotational speed of first electrical contact 138 away from second electrical contact 142.

Rotation of upper portion 184 of upper link 128 to pivot about second pivot pin 118 in tenth direction 186 causes cradle 112 to pivot about third pivot pin 120 in an eleventh direction 188. As shown in FIGS. 1-3, cradle 112 is latched to latch 114 during normal operations. As cradle 112 rotates in eleventh direction 188, latch 114 rotates in a twelfth direction 190 about fourth pivot pin 122 until cradle 112 is unlatched from latch 114 and allowed to rotate further in eleventh direction 188.

After the interrupt event is over, handle 108 may be manually rotated (i.e., by a human operator) in a thirteenth direction 192 opposite eleventh direction 188 to latch cradle 112 back into latch 114. Rotation of handle 108 in thirteenth direction 192 also rotates collapsible links 110, carrier 104, and main contact arm 106 back into the first position (i.e., the configuration shown in FIG. 1), such that an electrical connection between first electrical contact 138 and second electrical contact 142 is restored.

A circuit breaker may include one collapsible link device 100 or may include a plurality of collapsible link devices 100. When a circuit breaker includes a plurality of collapsible link devices 100, the circuit breaker may include a bar 194 (shown in FIG. 1) extending across all collapsible link devices 100. In the exemplary embodiment, bar 194 is positioned on a pivot end 196 (shown in FIG. 1) of carrier 104. At least one staple 198 (shown in FIG. 1) couples bar 194 to pivot end 196 of carrier 104. Bar 194 extends across pivot end 196 of carrier 104 of each collapsible link device 100 such that when one collapsible link device 100 opens because of an interrupt event, all collapsible link devices 100 within the circuit breaker also open.

Figure 5:
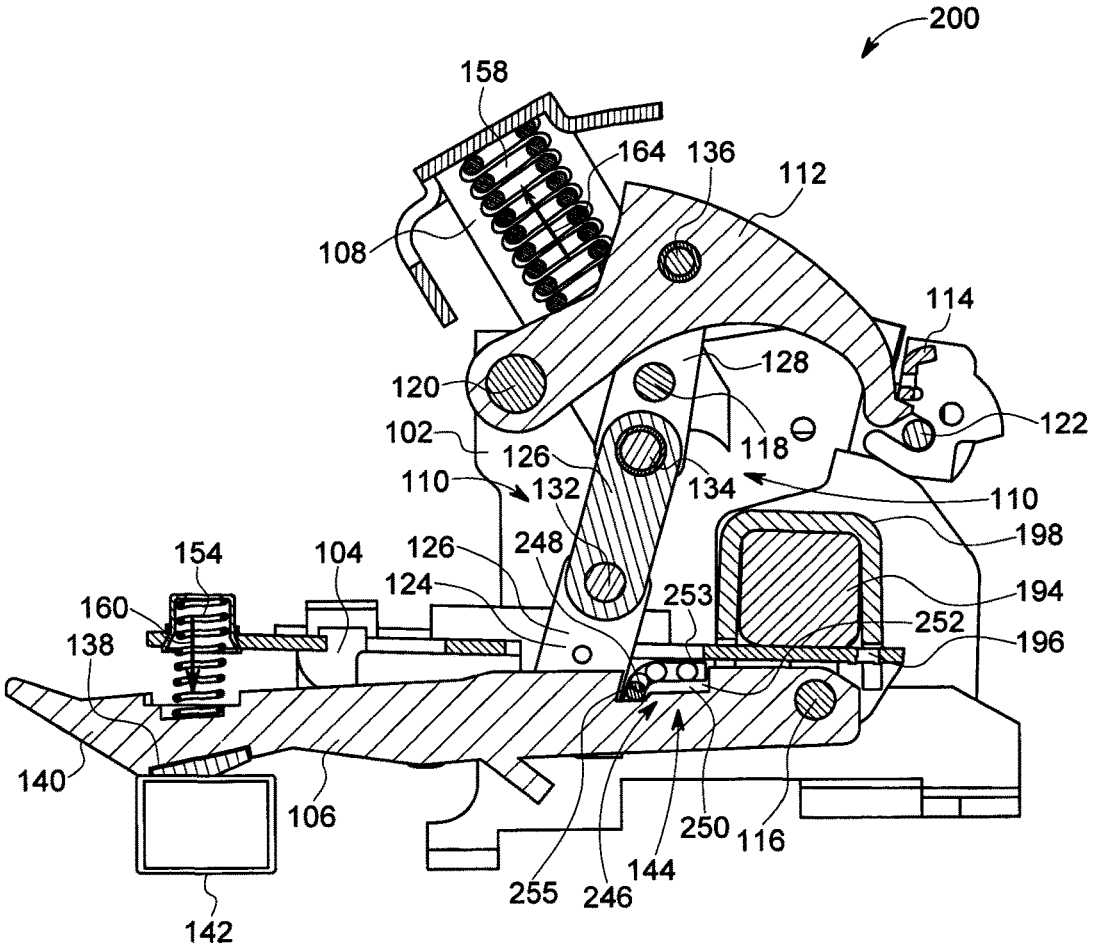
FIG. 5 is a schematic diagram of an alternative embodiment of the collapsible link device shown in FIG. 1 before an interrupt event.

FIGS. 5-8 are schematic diagrams of alternate embodiment of a collapsible link device 200 before the causing of an interrupt event. FIG. 5 is a schematic diagram of an exemplary embodiment of collapsible link device 200 for use in a circuit breaker before an interrupt event (i.e., during normal operation). Like components will be given like reference numerals for ease of understanding. In the exemplary embodiment, a release mechanism 144 includes a link lock pin assembly 246. Link lock pin assembly 246 includes a link lock pin 248 positioned within a carrier groove 250 and a main contact arm groove 252. Carrier groove 250 and main contact arm groove 252 each include a corresponding L-shape with a long portion 253 and a short portion 255. Short portion 255 is oriented substantially perpendicularly to long portion 253. Link lock pin 248 is configured to slide within carrier groove 250 and main contact arm groove 252. In a first position (i.e., in the absence of an interrupt event), link lock pin 248 is positioned within short portion 255 of carrier groove 250 and main contact arm groove 252 and is pressed against lower link 124, preventing rotation of lower link 124 and collapse of collapsible links 110. As such, link lock pin assembly 246 is configured to maintain electrical contact between first electrical contact 138 and second electrical contact 142 by maintain carrier 104, main contact arm 106, and collapsible links 110 in a first position, or the configuration shown in FIG. 5.

Figure 6:
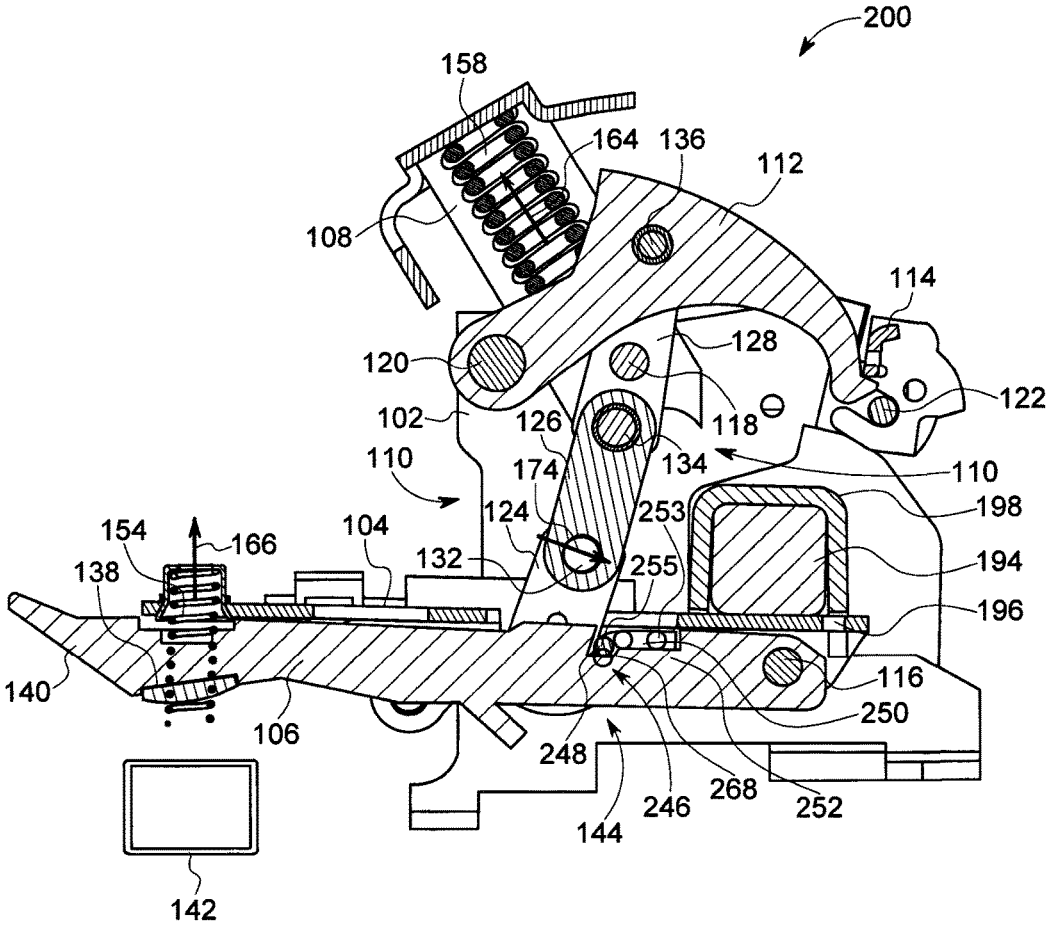
FIG. 6 is a schematic diagram of the collapsible link device shown in FIG. 5 at the initiation of an interrupt event.
Figure 7:
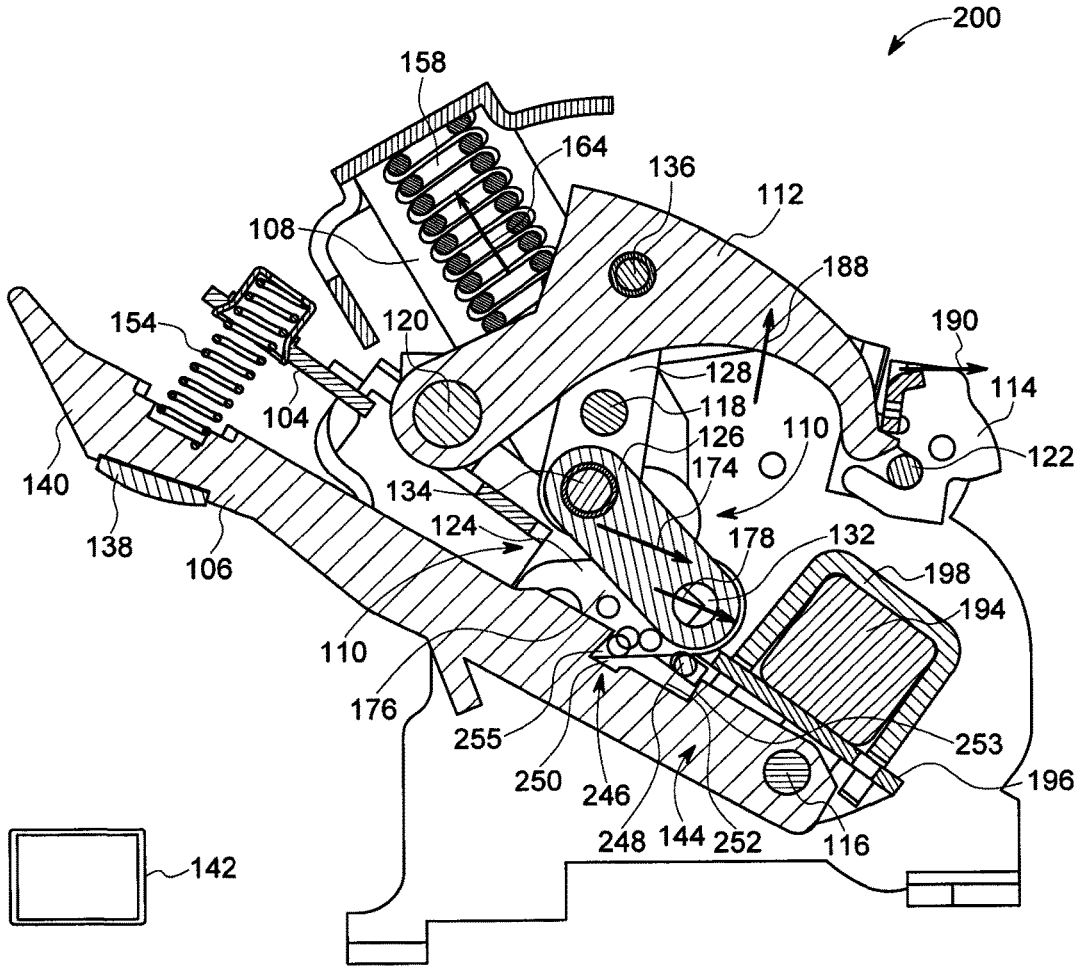
FIG. 7 is a schematic diagram of the collapsible link device shown in FIG. 5 after the initiation of an interrupt event.

During an interrupt event, such as a short circuit of the electrical system, electromagnetic forces repel first electrical contact 138 away from second electrical contact 142. FIG. 6 is a schematic diagram of collapsible link device 200 at the initiation of an interrupt event. FIG. 7 is a schematic diagram of collapsible link device 200 after the initiation of an interrupt event. As the electromagnetic forces repelling first electrical contact 138 away from second electrical contact 142 increase, main contact arm 106 begins to pivot or rotate about first pivot pin 116 in fourth direction 166. Main arm spring 154 includes a predetermined spring constant and imparts a predetermined resistive force against the rotation of main contact arm 106 in fourth direction 166. As such, main arm spring 154 is operable to prevent rotation of main contact arm 106 until the repulsive electromagnetic forces exceed the predetermined resistive force of main arm spring 154.

As main contact arm 106 rotates about first pivot pin 116, a contact portion 268 of main contact arm 106 makes contact with and slides link lock pin 248 out of short portion 255 of carrier groove 250 and main contact arm groove 252. As link lock pin 248 slides link lock pin 248 out of short portion 255 of carrier groove 250 and main contact arm groove 252, lower link 124 is allowed to rotate about a fifth pivot pin 130 in a seventh direction 174, collapsing collapsible links 110. Once collapsible links 110 have collapsed as described above, link lock pin 248 slides into long portion 253 of carrier groove 250 and main contact arm groove 252, allowing collapsible links 110 to collapse further and allowing carrier 104 and main contact arm 106 to rotate first electrical contact 138 away from second electrical contact 142.

Figure 8:
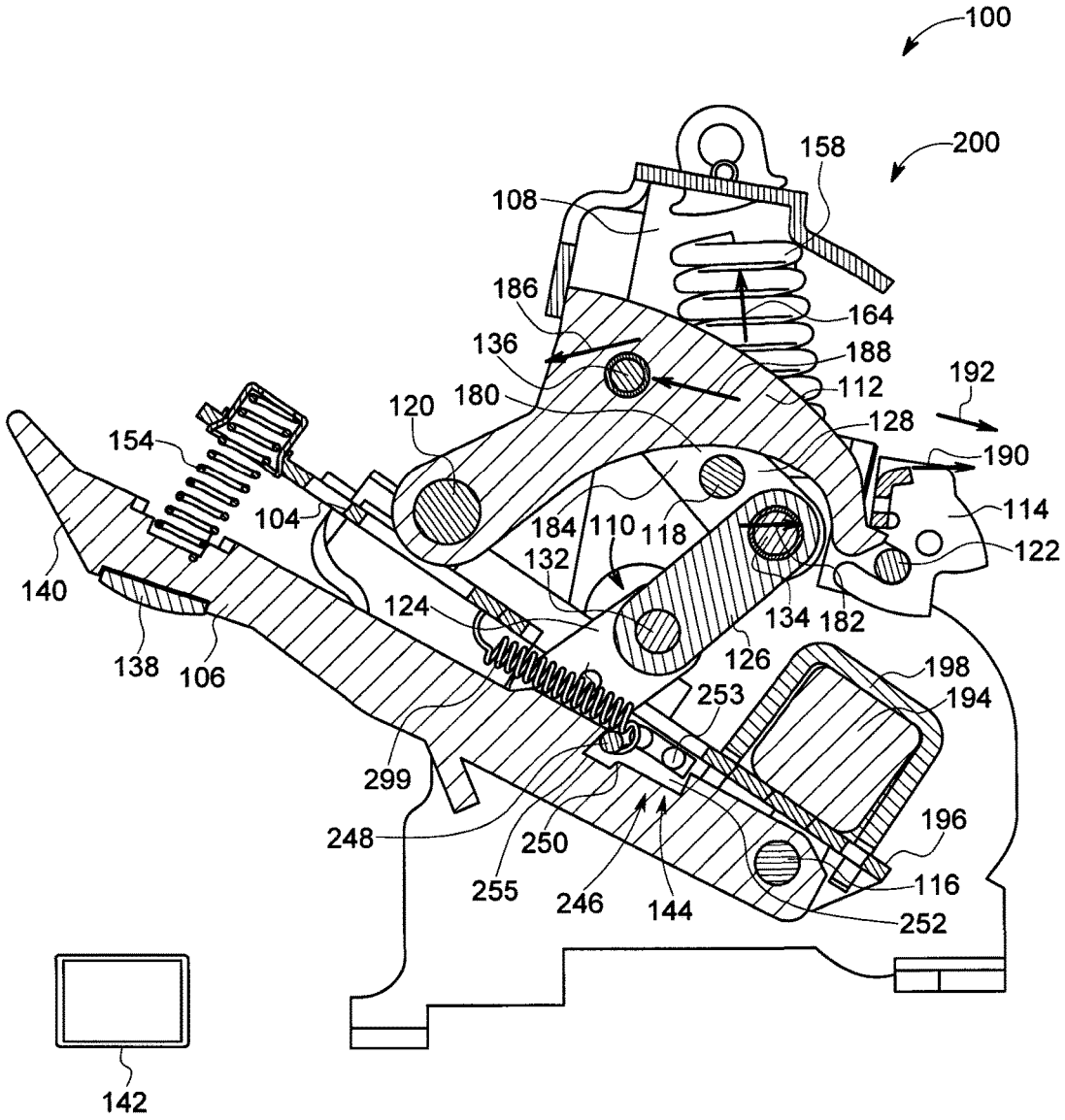
FIG. 8 is a schematic diagram of the collapsible link device shown in FIG. 5 after an interrupt event is complete.

FIG. 8 is a schematic diagram of collapsible link device 200 after an interrupt event is complete. After the interrupt event is over, handle 108 may be manually rotated in thirteenth direction 192 to latch cradle 112 back into latch 114. Rotation of handle 108 in thirteenth direction 192 also rotates collapsible links 110, carrier 104, and main contact arm 106 back into the first position or uncollapsed position (i.e., the configuration shown in FIG. 5), such that an electrical connection between first electrical contact 138 and second electrical contact 142 is restored. As the first position is restored, lock link pin 248 slides back into short portion 255 of carrier groove 250 and main contact arm groove 252. A spring 299 pulls lock link pin 248 back into short portion 255 of carrier groove 250 and main contact arm groove 252. Spring 299 is coupled to lock link pin 248 and to carrier 104.

Figure 9:
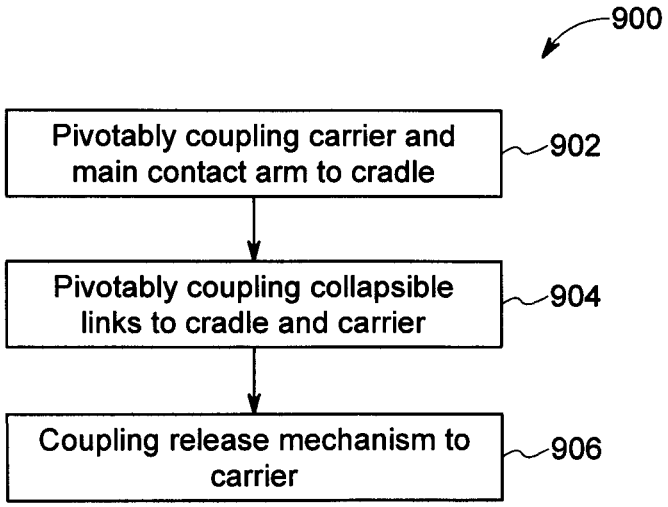
FIG. 9 is a flow diagram of a method of manufacturing a collapsible link device for a circuit breaker.

FIG. 9 is a flow diagram of a method 900 of manufacturing collapsible link device 100 for a circuit breaker. Method 900 includes pivotably coupling 902 carrier 104 and main contact arm 106 to side frame 102. The method also includes pivotably coupling 904 collapsible links 110 to side frame 102 and carrier 104. The method further includes coupling 906 release mechanism 144 to carrier 104.

The above-described embodiments of collapsible link devices and associated systems and methods are suited to quickly disconnect an electrical contact in a circuit breaker during an interrupt event, such as a short circuit event. The above-described embodiments include a plurality of collapsible links and a plurality of springs that speed up the process of disconnecting electrical contacts in a circuit breaker. Quickly disconnecting the electrical contact prevents damage to the circuit breaker and to downstream electrical equipment. As such, the above-described embodiments are suited to preventing damage to the circuit breaker and to downstream electrical equipment.

Exemplary embodiments of the above-described collapsible link devices and associated systems and methods of use thereof are not limited to the specific embodiments described herein, but rather, components of systems and/or steps of the methods may be utilized independently and separately from other components and/or steps described herein. For example, the methods, systems, and apparatus may also be used in combination with other systems requiring collapsible link devices, and the associated methods are not limited to practice with only the systems and methods as described herein. Rather, the exemplary embodiments can be implemented and utilized in connection with many other applications, equipment, and systems that may benefit from using the above-described embodiments of the above-described collapsible link devices and associated systems and methods of use thereof to improve the safety and reliability of electrical systems.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A collapsible link device for a circuit breaker, the collapsible link device comprising:

a side frame;

a carrier pivotably coupled to the side frame via a first pin;

a main contact arm pivotably coupled to the carrier via the first pin and comprising a first end comprising a first electrical contact;

a plurality of collapsible links pivotably coupled to the side frame and to the carrier, the plurality of collapsible links comprising an upper link, a cam link, and a lower link, the lower link pivotably coupled to the carrier via a second pin; and a release mechanism comprising a trip latch link pivotably coupled to the lower link and to the carrier, wherein the plurality of collapsible links are movable between an uncollapsed position in which the first electrical contact contacts a second electrical contact and a collapsed position that results from the first electrical contact separating from the second electrical contact.

2. The collapsible link device of claim 1, wherein the trip latch link comprises a first end and a second end, wherein the first end is configured to press against a flat portion of the carrier to maintain the plurality of collapsible links in the uncollapsed position.

3. The collapsible link device of claim 1, further comprising a biasing member coupled to the first end of the main contact arm and operable to prevent rotation of the main contact arm.

4. The collapsible link device of claim 3, wherein the biasing member comprises a spring.

5. The collapsible link device of claim 1, further comprising a biasing member coupled to the trip latch link, the biasing member operable to prevent rotation of the trip latch link.

6. The collapsible link device of claim 5, wherein the biasing member comprises a flat spring.

7. A collapsible link device for a circuit breaker, the collapsible link device comprising:

a side frame;

a carrier pivotably coupled to the side frame;

a main contact arm pivotably coupled to the carrier and comprising a first end comprising a first electrical contact;

a plurality of collapsible links pivotably coupled to the side frame and to the carrier; and a release mechanism pivotably coupled to at least one of the collapsible links and to the carrier, wherein the plurality of collapsible links are movable between an uncollapsed position in which the first electrical contact contacts a second electrical contact and a collapsed position that results from the first electrical contact separating from the second electrical contact, wherein the release mechanism comprises a trip latch link comprising a first end and a second end, wherein the first end is configured to press against a flat portion of the carrier to maintain the plurality of collapsible links in the uncollapsed position, and wherein the second end is arranged to contact a contact portion of the main contact arm to cause the plurality of collapsible links to transition from the uncollapsed position to the collapsed position.

8. The collapsible link device of claim 7, further comprising a biasing member coupled to the second end of the trip latch link and operable to prevent rotation of the trip latch link.

9. The collapsible link device of claim 8, wherein the biasing member comprises a flat spring.

10. The collapsible link device of claim 7, wherein the plurality of collapsible links comprises a lower link, a cam link, and an upper link.

11. The collapsible link device of claim 10, wherein the trip latch link is pivotably coupled to the lower link.

12. The collapsible link device of claim 7, further comprising a biasing member coupled to the first end of the main contact arm and operable to prevent rotation of the main contact arm.

13. The collapsible link device of claim 12, wherein the biasing member comprises a spring.

14. A collapsible link device for a circuit breaker, the collapsible link device comprising:

a side frame;

a carrier pivotably coupled to the side frame;

a main contact arm pivotably coupled to the carrier and comprising a first end comprising a first electrical contact;

a plurality of collapsible links pivotably coupled to the side frame and to the carrier; and a release mechanism pivotably coupled to at least one of the collapsible links and to the carrier, wherein the plurality of collapsible links are movable between an uncollapsed position in which the first electrical contact contacts a second electrical contact and a collapsed position that results from the first electrical contact separating from the second electrical contact, and wherein the release mechanism comprises a link lock pin positioned within a groove defined in the carrier and the main contact arm.

15. The collapsible link device of claim 14, wherein the groove includes a first portion and a second portion, the link lock pin arranged to press against the lower link to prevent the plurality of links from collapsing when the link latch pin is positioned in the first portion of the groove.

16. The collapsible link device of claim 15, wherein the first portion of the groove is oriented substantially perpendicular to the second portion of the groove.

17. The collapsible link device of claim 15, further comprising a biasing member configured to prevent sliding of the link lock pin within the groove.

18. The collapsible link device of claim 17, wherein the biasing member comprises a spring.

* * * * *